United States Patent [19]

Saito et al.

[11] 4,417,113

[45] Nov. 22, 1983

[54] STRUCTURE OF PUSH-BUTTON DEVICE

[75] Inventors: Motoyuki Saito; Satoru Fukutome, both of Tanashi, Japan

[73] Assignee: Citizen Watch Company Limited, Tokyo, Japan

[21] Appl. No.: 231,822

[22] Filed: Feb. 5, 1981

[30] Foreign Application Priority Data

Feb. 5, 1980 [JP] Japan ..... 55-13232[U]

[51] Int. Cl.[3] ..... H01H 9/04; H01H 3/12

[52] U.S. Cl. ..... 200/302; 200/340

[58] Field of Search ..... 200/302, 330, 340; 368/289, 291

[56] References Cited

U.S. PATENT DOCUMENTS 4,023,002 5/1977 Wuthrich et al. ..... 200/302
4,031,348 6/1977 Eberhardt ..... 200/302
4,259,551 3/1981 Ohtani et al. ..... 200/302
4,287,400 9/1981 Kitik et al. ..... 200/302

FOREIGN PATENT DOCUMENTS 1087663 8/1960 Fed. Rep. of Germany ..... 200/302
1590089 4/1970 Fed. Rep. of Germany ..... 200/302

*Primary Examiner*—Willis Little
*Attorney, Agent, or Firm*—Jordan and Hamburg

[57] ABSTRACT

In a push-button device having a waterproofing O-ring disposed between the inner wall of a pipe and the shaft portion of a button body, the structure of said push-button device characterized in that a non-metallic, resilient sleeve for preventing the invasion of dust and for restoring the push-button is disposed in a clearance formed between the head portion of the button body and a stepped portion provided on said inner wall of said pipe.

5 Claims, 7 Drawing Figures

STRUCTURE OF PUSH-BUTTON DEVICE

BACKGROUND OF THE INVENTION

This invention relates to push-button devices and, more particularly, to a push-button device specifically suited for use in a watchcase.

A conventional push-button device used in a watchcase generally employs a metallic coil spring through which a shaft portion of a button body extends. The coil spring serves to restore the button body to its original position. This coil spring does tend to be contaminated with water and dust and may therefore corrode and become clogged. This causes the push-button to act improperly. Another problem is that contaminants such as dust which attach themselves to a sealing ring may deteriorate the waterproofing action of the sealing ring.

One example of a conventional push-button device is typified by the structure shown in FIG. 1. As illustrated, a pipe 12 having a stepped portion 12*a* is secured to a watchcase 10, the shaft portion 14*a* of a button body 14 is inserted into the pipe 12, and a waterproofing sealing ring or O-ring 16 is disposed between the shaft portion 14*a* of the button body and the inner wall of the pipe 12. A snap ring 18 is fastened to the end 14*b* of the button body 14 to prevent the button body from falling out of the case 10. A metallic coil spring 20 is disposed in the clearance formed between the stepped portion 12*a* of the pipe 2 and the head portion 14*c* of the button body 14. The coil spring serves to restore the button body 14 to its original position.

While the O-ring 16 succeeds in protecting the interior of the case 10 from the invasion of water, the coil spring 20 does tend to be contaminated with water and dust and may therefore corrode and become clogged. A frequent result is improper push-button action that may not allow normal operation of the push-button. Another problem is that contaminants such as dust which attach themselves to the O-ring 16 may deteriorate the waterproofing action of the O-ring.

SUMMARY OF THE INVENTION

It is therefore an object of the present invention to provide a push-button device which can eliminate the shortcomings encountered in the prior art.

It is another object of the present invention to provide a push-button device for use in a watchcase, which device is highly effective to prevent penetration of contaminants into the watchcase.

DETAILED DESCRIPTION OF PREFERRED EMBODIMENTS

Figure 1:
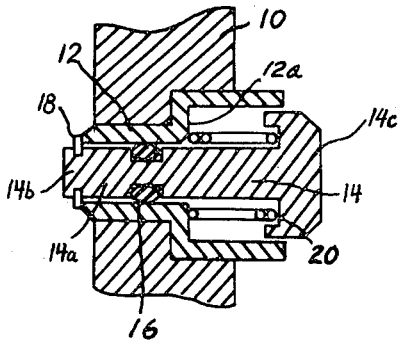
Fig. 1 PRIOR ART
FIG. 1 is a cross-sectioal view of an example of a conventional push-button device.
Figure 2:
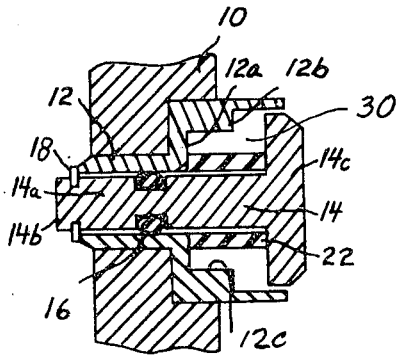
FIGS. 2 and 3 are cross-sectional views of a preferred embodiment of a push-button device according to the present invention, FIG. 2 showing the push-button prior to depression, and FIG. 3 showing the push-button when depressed.
Figure 3:
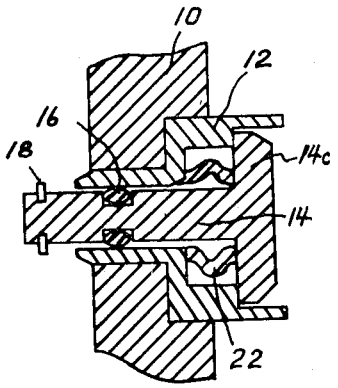
Figure 4:
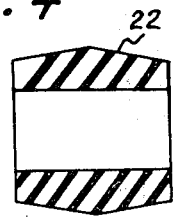
FIG. 4 is a cross-sectional view of a modification of a push-button restoring member forming part of the push-button device shown in FIGS. 2 and 3.
Figure 5:
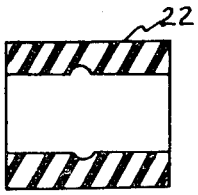
FIG. 5 is a cross-sectional view of another modification of a push-button restoring member forming part of the push-button device shown in FIGS. 2 and 3.

FIGS. 2 and 3 illustrate a preferred embodiment of the present invention, FIG. 2 showing the state prior to depression of the push-button, and FIG. 3 the state as the push-button is depressed. In FIGS. 2 and 3, like reference numerals designate parts indentical to those shown in FIG. 1. In particular, the structure shown in FIGS. 2 and 3 is exactly the same as that shown in FIG. 1 except for the fact that the inner wall of the pipe 12 is formed to include two shoulders or steppped portions 12*a* and 12*b*, with a non-metallic, resilient pipe or sleeve 22 being disposed in the clearance formed between the stepped portion 12*a* and the head portion 14*c* of the button body 14, and the stepped portion 12*b* receiving the head portion 14*c* when the push-button body 14 is fully depressed. The pipe 12 also has a sleeve accommodating bore 12*c*, in which the sleeve 22 is disposed. The sleeve 22 has its outer diameter smaller than the bore of the pipe 12, to provide a clearance 30 therebetween to effect buckling of the sleeve 22 at a central portion thereof as will be described later. The resilient pipe 22 comprises a resilient member consisting of rubber or resin or the like. The ends of the resilient pipe 22 are in abutting contact with the stepped portion 12*a* of the pipe 12 and with the head portion 14*c* of the button body 14, respectively, prior to depression of the push-button. Contaminants are prevented from directly invading the area of the shaft portion 14*a* of the button body 14 in this state. When the push-button is depressed the resilient pipe 22 buckles about the central portion thereof, as shown in FIG. 3, the result being an increase in the axially directed restoring force that acts to restore the button body to its original position. The stepped portion 12*b* of the pipe 12 receives the head portion 14*c* of the button body 14 as the push-button is depressed, thereby protecting the resilient pipe 22 from the destruction that would result if the push-button were depressed to an excessive degree. This provides a readily operable and practical push-button. Buckling of the resilient pipe 22 when the push-button is depressed may be facilitated by providing an annular recess or concavity (as shown in FIG. 5) on the inner wall of the resilient pipe, or by so forming the resilient pipe 22 as to provide the central portion thereof with a bulging configuration (as shown in FIG. 4). The push-button is restored to the state shown in FIG. 2 by the resilient restoring force of the resilient pipe 22 when pressure is released from the button body.

Figure 6:
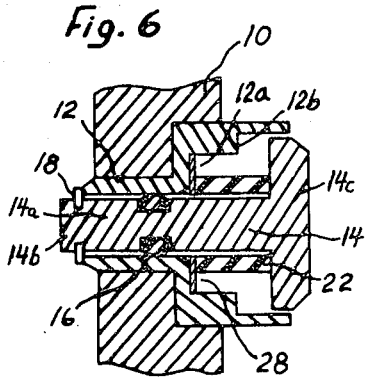
FIGS. 6 and 7 are cross-sectional views of another preferred embodiment of a push-button device according to the present invention, FIG. 2 showing the push-button prior to depression, and FIG. 3 showing the push-button when depressed.
Figure 7:
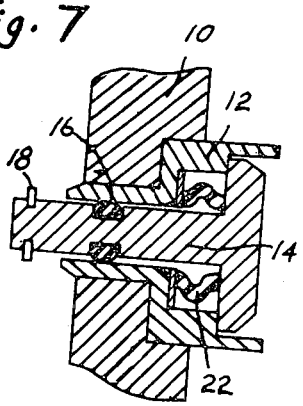

FIGS. 6 and 7 show another preferred embodiment of a push-button device according to the present invention, with the same or corresponding parts bearing the same reference numerals as those used in FIGS. 2 and 3. In FIGS. 6 and 7, a washer or ring 28 is disposed between the end of resilient pipe 22 and shoulder 12*a* of pipe 12.

Providing the resilient pipe 22 as described above prevents contaminants such as dust from directly invading the area of the shaft portion 14*a* of the button body 14, and lessens the deterioration in waterproofing effect caused by contaminants attaching themselves to the O-ring 16. Moreover, incidents of improper push-button action due to corrosion are reduced by employing the non-metallic resilient pipe 22 instead of a metallic button restoring member.

What is claimed is:

1. A push-button device comprising:

a pipe having a first and a second shoulder;

a button body having a head portion and a shaft portion extending from said head portion, said shaft portion being slidably received in said pipe;

a waterproofing sealing ring disposed between an inner wall of said pipe and the shaft portion of said button body; and a non-metallic, resilient sleeve disposed between the head portion of said button body and the first shoulder of said pipe, said sleeve serving as means for restoring said button body to its original position and serving as means for preventing entry of dust toward said sealing ring, said second shoulder being engaged by said head portion when the button body is depressed thereby limiting the extent of depression of said resilient sleeve.

2. A push-button device according to claim 1, wherein said resilient sleeve has a central portion formed with a bulging configuration.

3. A push-button device according to claim 1, wherein said resilient sleeve has an inner wall formed with a concavity.

4. A push-button device according to claim 1, further comprising a washer disposed between the shoulder of said pipe and said resilient sleeve.

5. A push-button device comprising:

a pipe having a bore and shoulder;

a button body having a head portion and a shaft portion extending from said head portion, said shaft portion being slidably received in said pipe;

a waterproofing sealing ring disposed between an inner wall of said pipe and the shaft portion of said button body; and a non-metallic, resilient sleeve disposed in the bore of said pipe between the head portion of said button body and the shoulder of said pipe, said sleeve serving as means for restoring said button body to its original position and serving as means for preventing entry of dust toward said sealing ring, and said sleeve having its outer diameter smaller than the bore of said pipe to enable buckling effect at a central portion of said sleeve.

* * * * *